US009583067B2

(12) United States Patent
Yang et al.

(10) Patent No.: US 9,583,067 B2
(45) Date of Patent: Feb. 28, 2017

(54) DRIVING METHOD FOR LIQUID CRYSTAL DISPLAY DEVICE AND DRIVING CIRCUIT THEREOF

(71) Applicant: SITRONIX TECHNOLOGY CORP., Hsinchu County (TW)

(72) Inventors: Chen-Yuan Yang, Hsinchu County (TW); Kuo Ching Yen, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 13/650,405

(22) Filed: Oct. 12, 2012

(65) Prior Publication Data

US 2013/0093735 A1 Apr. 18, 2013

(30) Foreign Application Priority Data

Oct. 14, 2011 (TW) ..... 100137239 A

(51) Int. Cl.
*G09G 3/36* (2006.01)

(52) U.S. Cl.
CPC ..... *G09G 3/3685* (2013.01); *G09G 3/3674* (2013.01); *G09G 2310/0218* (2013.01);
(Continued)

(58) Field of Classification Search
CPC ..... G09G 2310/02; G09G 2310/06; G09G 2310/0213; G09G 2310/0224; G09G 3/36; G09G 3/3666
(Continued)

(56) References Cited

U.S. PATENT DOCUMENTS 6,084,563 A * 7/2000 Ito et al. ..... 345/100
6,362,803 B1 * 3/2002 Tomomura et al. ..... 345/94
(Continued)

FOREIGN PATENT DOCUMENTS

JP H02-130525 A 5/1990
JP H02-163725 A 6/1990
(Continued)

*Primary Examiner* — Lun-Yi Lao
*Assistant Examiner* — Elliott Deaderick
(74) *Attorney, Agent, or Firm* — Rosenberg, Klein & Lee

(57) ABSTRACT

The LCD device comprises a plurality of scan groups and a plurality of data electrodes; each scan group comprises a plurality of scan electrodes. The driving method comprises the following steps. First the scan driving circuit provides a plurality of scan signals to the plurality of scan electrodes of the plurality of scan groups, respectively. Each scan signal includes at least a select signal, at least a non-select signal, at least a select cycle, and at least a non-select cycle. The select signal is located in the select cycle, while the non-select signal, the non-select cycle. When an Nth scan electrode is located in the select cycle, an (N−1)th or (N+1)th scan electrode of the plurality of scan electrodes is located in the non-select cycle. Then, the data driving circuit provides a data signal to each of the data electrodes according to a plurality of display data for driving the LCD device to display an image by using the plurality of scan signals and the plurality of data signals. Thereby, the imbalance wire coupling effect among scan electrodes can be eliminated and thus improving the display efficiency of the LCD device.

15 Claims, 12 Drawing Sheets

(52) U.S. Cl.
CPC ..... *G09G 2310/067* (2013.01); *G09G 2320/0209* (2013.01)

(58) Field of Classification Search
USPC ..... 345/87, 94, 98, 103, 204, 208, 210
See application file for complete search history.

(56) References Cited

U.S. PATENT DOCUMENTS

| | | | | |
|---|---|---|---|---|
| 6,806,858 | B2 | 10/2004 | Kurumisawa et al. | |
| 2002/0105510 | A1* | 8/2002 | Tsuchiya | G09G 3/3625 345/211 |
| 2002/0196241 | A1* | 12/2002 | Morita | 345/204 |
| 2004/0095308 | A1 | 5/2004 | Kim et al. | |
| 2004/0183768 | A1* | 9/2004 | Yamato et al. | 345/98 |
| 2007/0205974 | A1 | 9/2007 | Iizuka et al. | |
| 2008/0079001 | A1* | 4/2008 | Umezaki | H01L 27/12 257/59 |
| 2008/0079685 | A1* | 4/2008 | Umezaki | G09G 3/3677 345/100 |
| 2008/0284929 | A1* | 11/2008 | Kimura | 349/38 |
| 2009/0027320 | A1 | 1/2009 | Lai et al. | |
| 2009/0040146 | A1* | 2/2009 | Takeuchi et al. | 345/63 |
| 2010/0097366 | A1* | 4/2010 | Kitayama et al. | 345/213 |
| 2011/0169793 | A1 | 7/2011 | Chen et al. | |

FOREIGN PATENT DOCUMENTS

| | | | |
|---|---|---|---|
| JP | 2000-56734 | A | 2/2000 |
| JP | 2003-58121 | A | 2/2003 |
| TW | 200735034 | A | 9/2007 |

* cited by examiner

| | Write Bus MUX | |
|---|---|---|
| | *Normal* | *ITW* |
| RAMDI [0] | DI[0] | DI[0] |
| RAMDI [1] | DI[1] | DI[2] |
| RAMDI [2] | DI[2] | DI[4] |
| RAMDI [3] | DI[3] | DI[6] |
| RAMDI [4] | DI[4] | DI[1] |
| RAMDI [5] | DI[5] | DI[3] |
| RAMDI [6] | DI[6] | DI[5] |
| RAMDI [7] | DI[7] | DI[7] |

Figure 8B

| | Read Bus MUX | |
|---|---|---|
| | *Normal* | *ITR* |
| DO [0] | RAMDO [0] | RAMDO [0] |
| DO [1] | RAMDO [1] | RAMDO [4] |
| DO [2] | RAMDO [2] | RAMDO [1] |
| DO [3] | RAMDO [3] | RAMDO [5] |
| DO [4] | RAMDO [4] | RAMDO [2] |
| DO [5] | RAMDO [5] | RAMDO [6] |
| DO [6] | RAMDO [6] | RAMDO [3] |
| DO [7] | RAMDO [7] | RAMDO [7] |

Figure 9B

DRIVING METHOD FOR LIQUID CRYSTAL DISPLAY DEVICE AND DRIVING CIRCUIT THEREOF

FIELD OF THE INVENTION

The present invention relates generally to a driving method and the driving circuit thereof, and particularly to a driving method and the driving circuit thereof capable of balancing the wire coupling effect.

BACKGROUND OF THE INVENTION

Since the invention of the black-and-white televisions adopting cathode ray tubes, display technologies have been evolving rapidly and continuously. Nonetheless, because the black-and-white televisions adopting cathode ray tubes have the drawbacks of huge size, heaviness, high radiation, and inferior pixels, flat display technologies are developing continuously for new improvements. Among all flat display technologies, liquid crystal display (LCD) technology is the most mature and popular one thanks to its small size, power saving, radiation free, full color, and easy carrying advantages. Its applications include mobile phones, translators, digital cameras, digital camcorders, personal digital assistants (PDAs), notebook computers, and even desktop computers.

In addition, although the LCD technology has become mature, there still exist some problems. When the display module of a general LCD is operating, the LCD panel of the display module is usually interfered to various degrees such as the electrostatic interference or the wire coupling effect, where the wire coupling effect of LCD varies the colors and produces stripes on the display. FIG. 1A shows waveforms of the driving method for LCD device according to the prior art. As shown in the figure, the display panel comprises a plurality of scan modules (not shown in the figure) and a plurality of data electrode (not shown in the figure). Each scan module includes a plurality of scan electrodes, as shown in FIG. 1A. The plurality of scan electrodes X1~X4 form a scan group. Besides, the LCD device will transmit a plurality of scan signals to the plurality of scan electrodes X1~X4 simultaneously.

Nonetheless, because the plurality of scan electrodes X1~X4 are adjacent scan electrodes and the scan signals are transmitted to the plurality of scan electrodes X1~X4 simultaneously, during the transmission, the wire coupling effect will occur on the plurality of scan electrodes X1~X4. As shown in FIG. 1A, influenced by a select signal of one of the plurality of scan electrodes X1~X4, pulses will occur on select signals, which will influence the displaying effect of the LCD, namely, varying the colors and producing stripes on the display.

Moreover, FIG. 1B shows waveforms of another driving method for LCD device according to the prior art. As shown in the figure, a plurality of scan electrodes of an LCD device transmit a plurality of scan signals to a plurality of scan groups. Nonetheless, while transmitting the plurality of scan signals to the plurality of scan electrodes of different scan groups, the wire coupling effect also occurs on the scan electrodes among the plurality of scan groups. As shown in FIG. 1B, influenced by select signals on the scan signals of the scan electrodes of different scan groups, pulses will occur on the signals of the scan electrodes of different scan groups, which will influence the displaying effect of the LCD, namely, varying the colors and producing stripes on the display. Furthermore, the displaying efficiency of the LCD device will be influenced as well.

Accordingly, the present invention provides a novel driving method for LCD device and the driving circuit thereof for avoiding the imbalanced wire coupling effect among a plurality of scan electrodes of an LCD device and hence improving its displaying efficiency. The problems described above can be thereby solved.

SUMMARY

An objective of the present invention is to provide a driving method for LCD device and the driving circuit thereof. The present invention eliminates the imbalance wire coupling effect among scan electrodes by locating an (N−1) th or an (N+1)th scan electrode of a plurality of scan electrodes to a non-select cycle when an Nth scan electrode is located to a select cycle. Thereby, the display efficiency of the LCD device can be improved.

Another objective of the present invention is to provide a driving method for LCD device and the driving circuit thereof. By providing a plurality of scan signals to a plurality of scan electrodes for each frame, respectively, and grouping a plurality of frames to a cycle, the waveforms of the select signal received by the Nth scan electrode in a cycle for different frames are different. Thereby, the imbalanced wire coupling effect among scan electrodes can be eliminated, and thus improving the display efficiency of the LCD device.

The LCD device according to the present invention comprises a display panel, a plurality of scan groups, and a plurality of data electrodes; each scan group comprises a plurality of scan electrodes. The driving circuit of LCD device according to the present invention comprises a scan driving circuit and a data driving circuit. The driving method comprises the following steps. The scan driving circuit provides a plurality of scan signals to the plurality of scan electrodes of the plurality of scan groups, respectively. Each scan signal includes at least a select signal, at least a non-select signal, at least a select cycle, and at least a non-select cycle. The select signal is located in the select cycle, while the non-select signal, the non-select cycle. When an Nth scan electrode is located in the select cycle, an (N−1)th or (N+1)th scan electrode of the plurality of scan electrodes is located in the non-select cycle. Then, the data driving circuit provides a data signal to each of the data electrodes according to a plurality of display data for driving the LCD device to display an image by using the plurality of scan signals and the plurality of data signals. Thereby, by locating an (N−1)th or an (N+1)th scan electrode of a plurality of scan electrodes to a non-select cycle when an Nth scan electrode is located to a select cycle, the imbalance wire coupling effect among scan electrodes can be eliminated. Thus, the display efficiency of the LCD device can be improved.

Furthermore, the scan circuit according to the present invention provides the plurality of scan signals to the plurality of scan electrodes for each frame, respectively, and grouping a plurality of frames to a cycle, the waveforms of the select signal received by the Nth scan electrode in a cycle for different frames are different. Thereby, the imbalanced wire coupling effect among scan electrodes can be eliminated, and thus improving the display efficiency of the LCD device.

BRIEF DESCRIPTION OF THE DRAWINGS

FIG. 8B shows an index table of accessing the storage unit of the LCD device according to the present invention;

FIG. 9B shows another index table of accessing the storage unit of the LCD device according to the present invention.

DETAILED DESCRIPTION

In order to make the structure and characteristics as well as the effectiveness of the present invention to be further understood and recognized, the detailed description of the present invention is provided as follows along with embodiments and accompanying figures.

Figure 1A:
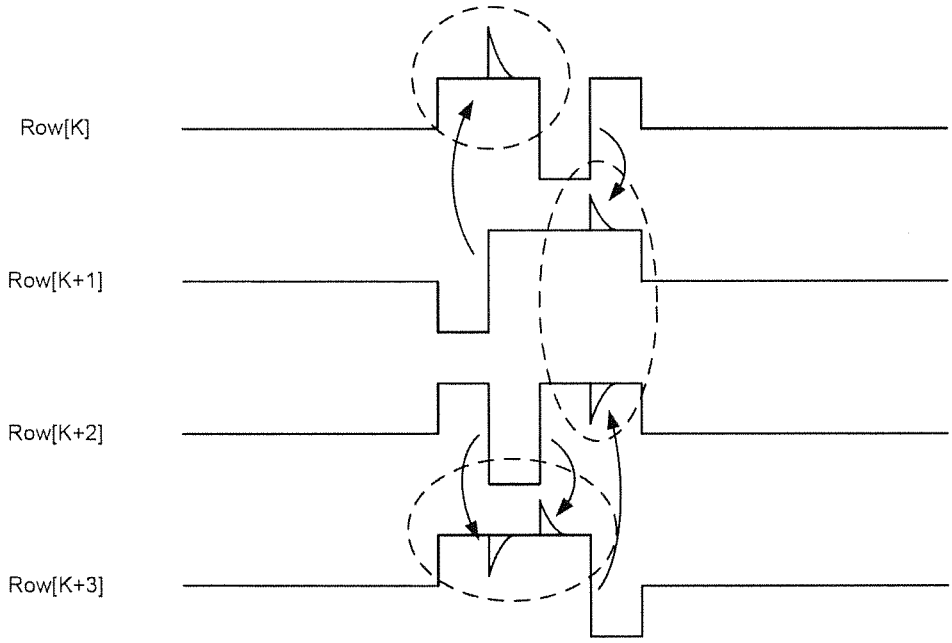
Figure 1A (Prior art)
FIG. 1A shows waveforms of the driving method for LCD device according to the prior art.
Figure 1B:
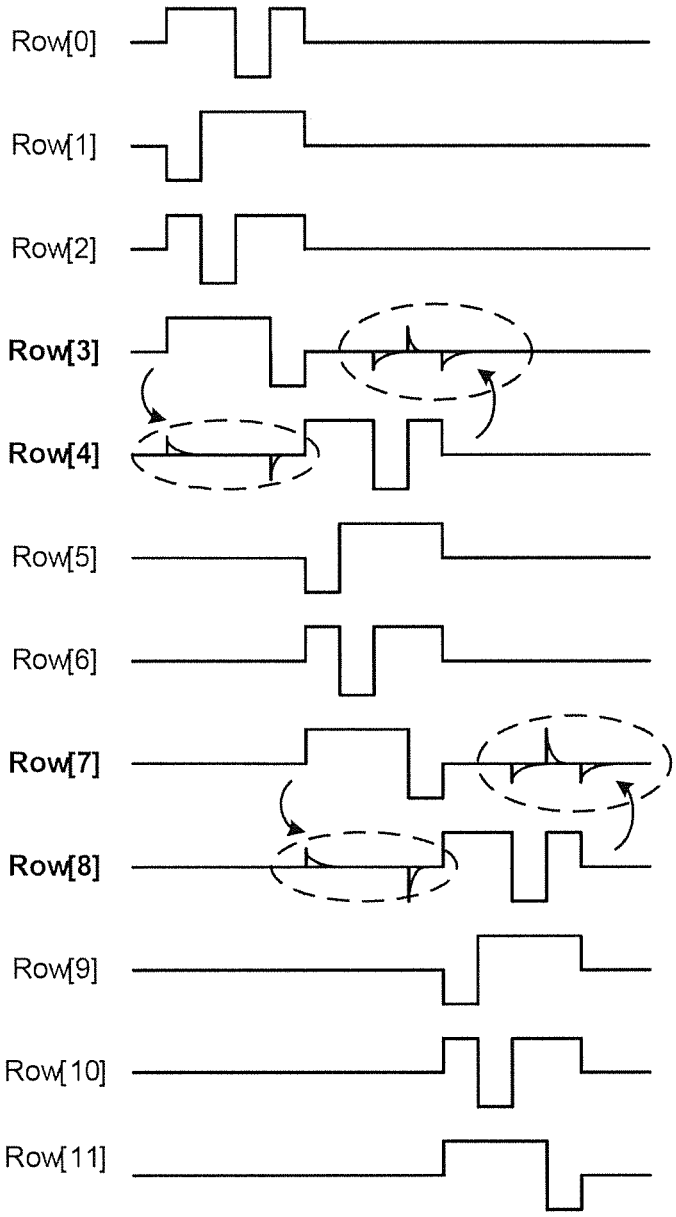
Figure 1B (Prior art)
FIG. 1B shows waveforms of another driving method for LCD device according to the prior art.
Figure 2:
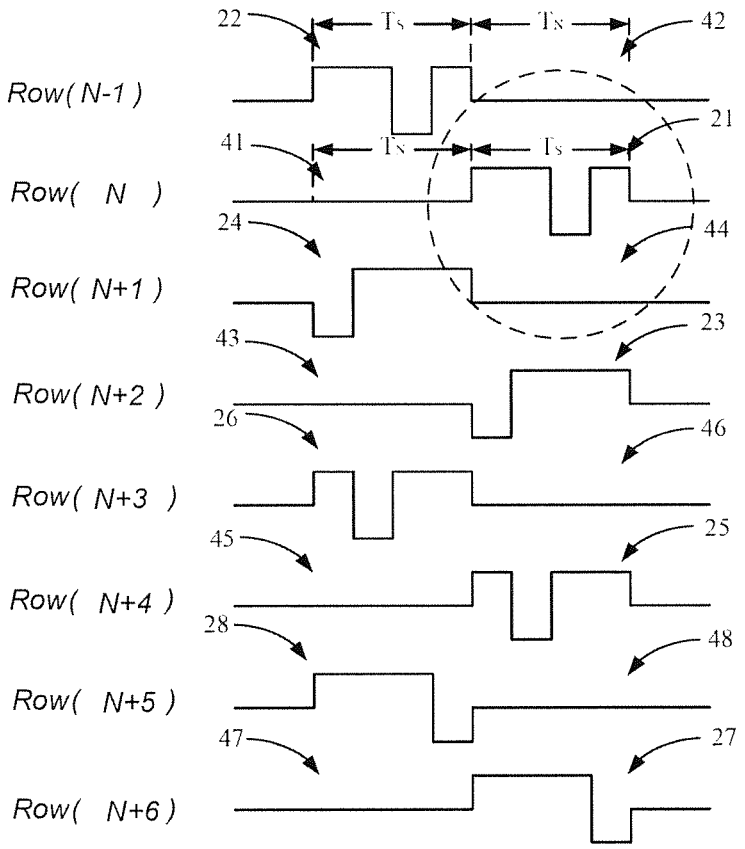
FIG. 2 shows waveforms of the driving method for LCD device according to an embodiment of the present invention.
Figure 4:
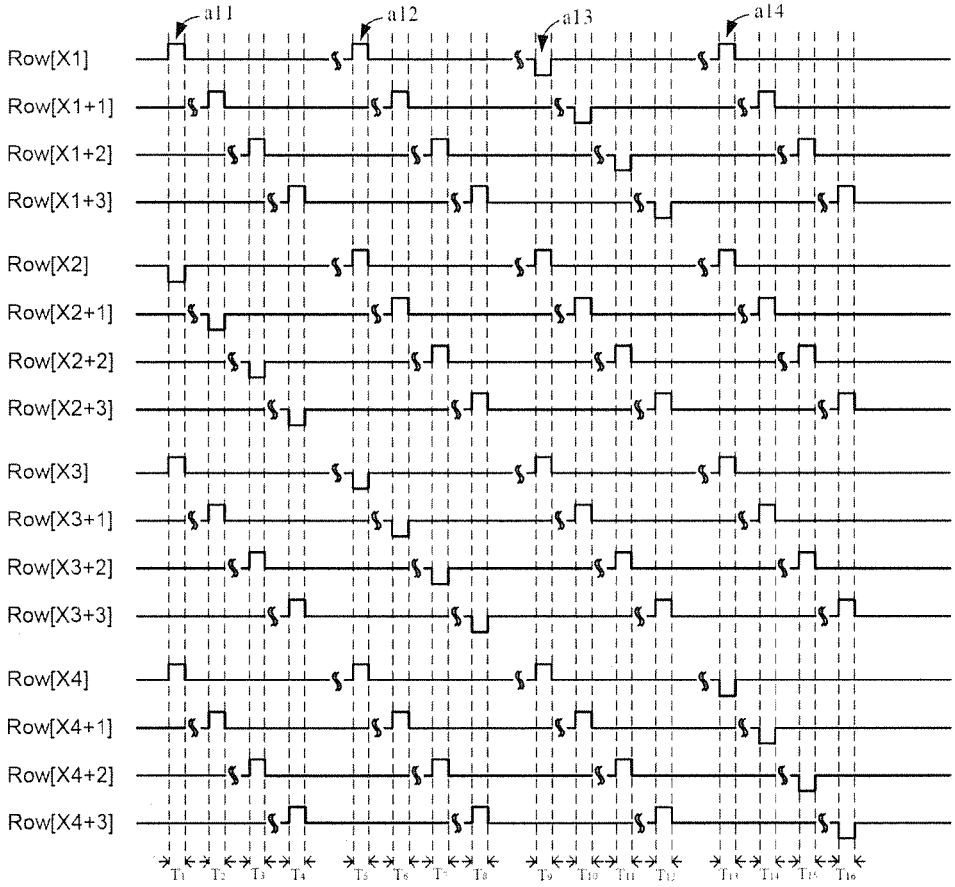
FIG. 4 shows waveforms of the driving method for LCD device according to another embodiment of the present invention.

FIG. 2 shows waveforms of the driving method for LCD device according to an embodiment of the present invention. The driving circuit 1 of LCD device according to the present invention comprises a display panel 10, a scan driving circuit 20, and a data driving circuit 30, as shown in FIG. 4. The display panel 10 has a plurality of scan groups and a plurality of data electrodes. Each of the scan groups includes a plurality of scan electrodes. The scan driving circuit 20 is used for producing a plurality of scan signals and transmitting the plurality of scan signals to the plurality of scan electrodes of the display panel 10. The data driving circuit 30 is used for producing a plurality of data signals and transmitting the plurality of data signals to the plurality of data electrodes. The display panel 10 can display images according to voltage difference between the plurality of scan signal and the plurality of data signals.

Refer again to FIG. 2. The driving method of the driving circuit for LCD device according to the present invention includes the following steps. First, the plurality of scan signal are supplied to the plurality of scan electrodes (Row(N−1)~Row(N+6)) of the plurality of scan groups, respectively. Each scan signal comprises at least a select signal, at least a non-select signal, at least a select cycle, and at least a non-select cycle. According to the present embodiment, the plurality of scan signals on the plurality of scan electrodes (Row(N−1)~Row(N+6)) include the select signal 21~27 and the non-select signals 41~47, respectively. The select signals 21~27 are located in a select cycle $T_S$ while the non-select signals 41~47 are located in a non-select cycle $T_N$. When an Nth scan electrode Row(N) of the plurality of scan electrodes is located in the select cycle $T_S$, an (N−1)th scan electrode Row(N−1) of the plurality of scan electrodes or an (N+1)th scan electrode Row(N+1) is located in the non-select cycle $T_N$. The present embodiment takes two scan groups as an example, as described below.

Figure 6:
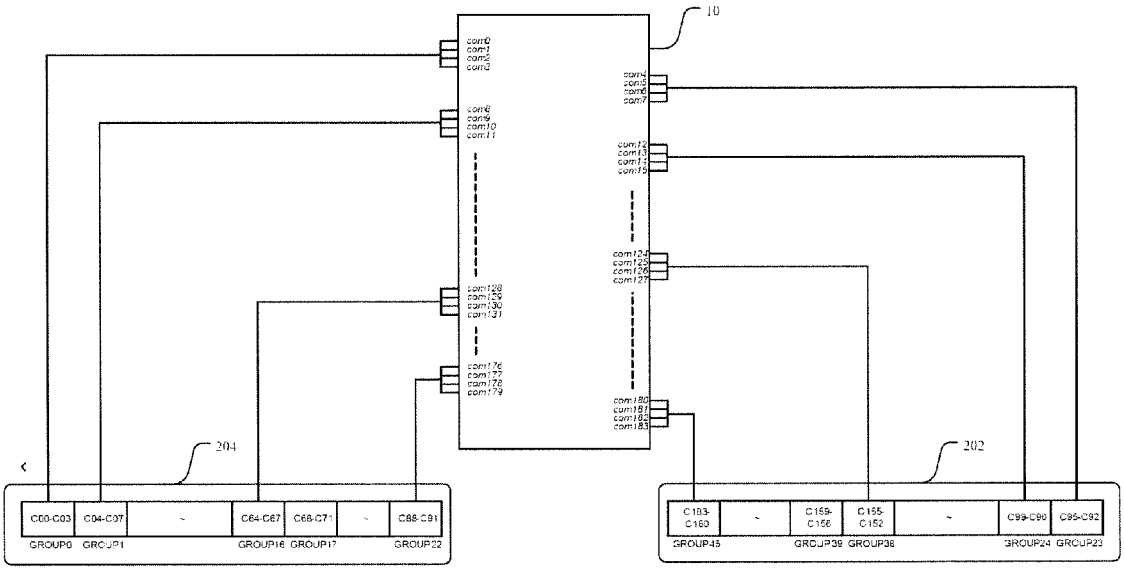
FIG. 6 shows a circuit diagram of the layout between the driving units and the display panel of the LCD device according to the present invention.

The present embodiment groups four select signals of the scan signals, such as the select signals 22, 24, 26, 28 of the plurality of scan signals belonging to the plurality of scan electrodes Row(N−1), Row(N+1), Row(N+3), Row(N+5) of the first scan group and the select signals 21, 23, 25, 27 of the plurality of scan signals belonging to the plurality of scan electrodes Row(N), Row(N+2), Row(N+4), Row(N+6) of the second scan group in FIG. 2. According to the figure, it is known that the present invention locates the (N−1)th scan electrode Row(N−1) or the (N+1)th scan electrode Row(N+1) to the non-select cycle $T_N$ as the Nth scan electrode Row(N) is located in the select cycle $T_S$, where the (N−1)th electrode Row(N−1), the Nth electrode Row(N), and the (N+1)th electrode Row(N+1) are located adjacent scan electrodes on the display panel 10, as shown in FIG. 6. Thereby, the imbalanced wire coupled effect among scan electrodes can be eliminated and hence improving the displaying efficiency of the LCD device. In addition, the present invention can also be the case when the Nth scan electrode Row(N) is located in the select cycle $T_S$, the (N−1)th scan electrode and the (N+1)th electrode are located in the non-select cycle $T_N$ for eliminating the imbalanced wire coupling effect among scan electrodes. In other words, according to the present embodiment, the select signals 21~27 of the plurality of scan signals in the two scan groups are interlaced. The first select signal 22 in the first scan group is provided first and them the first select signal 21 in the second scan group. Next, the second select signal 24 in the first scan group is provides followed by the provision of the second select signal 23 in the second scan group, and so on. Thereby, when each scan signal has the select signal in the select cycle, the adjacent scan signal will be in the non-select cycle and have the non-select signal 41~47 for eliminating the imbalanced wire coupling effect among scan electrodes.

Besides, the present invention is not limited to the embodiment described above. The cases in which the (N−1) th scan electrode Row(N−1) and the (N+1)th scan electrode Row(N+1) are located in the non-select cycle when the Nth scan electrode Row(N) is located in the select cycle $T_S$, as shown by the dashed circle in the figure, are all within the scope of the present invention.

Figure 3:
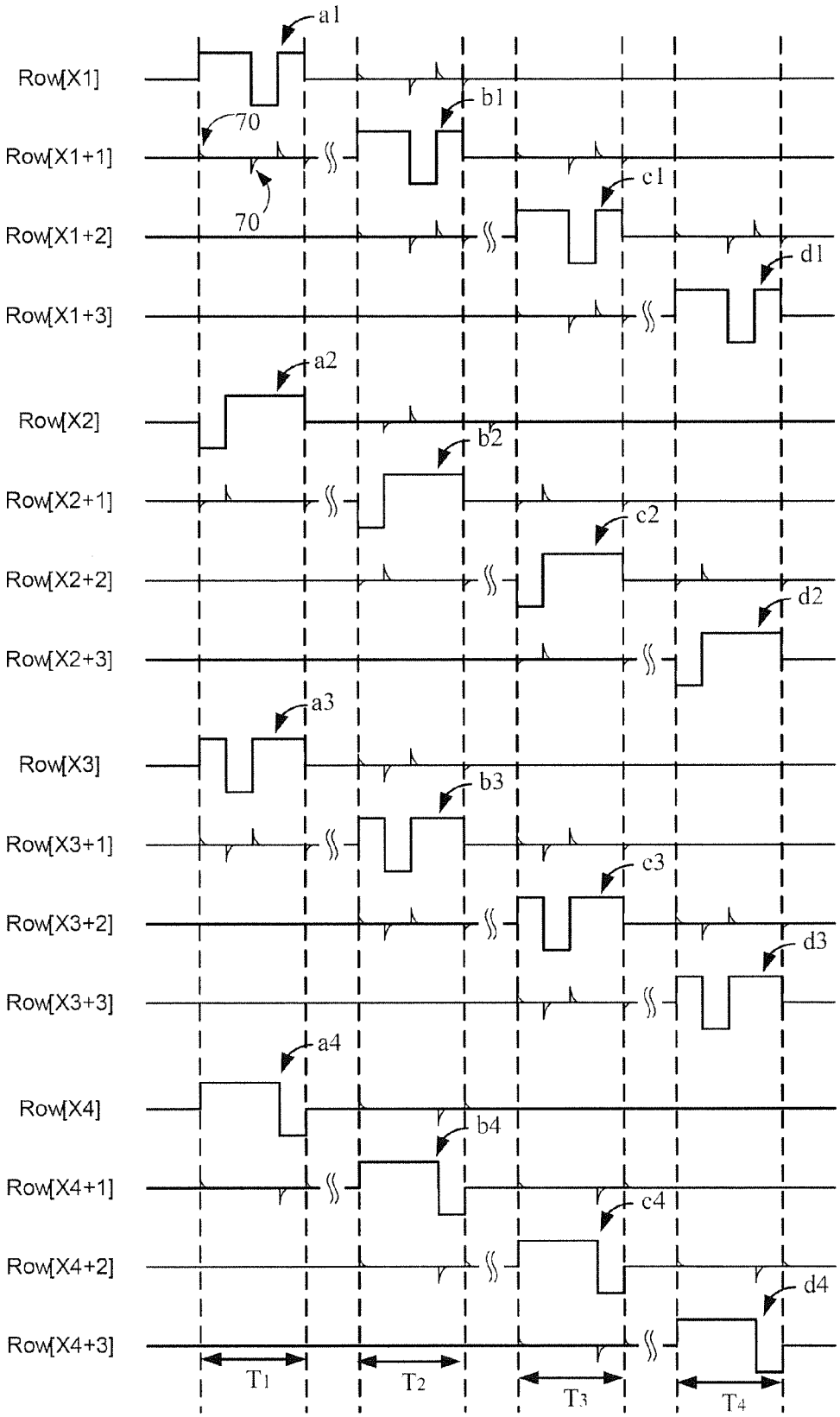
FIG. 3 shows waveforms of the driving method for LCD device according to another embodiment of the present invention.

FIG. 3 shows waveforms of the driving method for LCD device according to another embodiment of the present invention. As shown in the figure, the difference between the present embodiment and the previous one is that, according to the present embodiment, when there are m scan signals in each of the scan groups, there will be m types of waveforms for the select signals, where m≥2. In the present embodiment, there are 4 scan signals in each scan group; and there are 4 types of waveforms for the select signals. As shown in FIG. 3, the driving method comprises the following steps. First, the first select signal of each scan group is provided to the plurality of scan electrodes Row(X1)~Row(X1+3). Next, the second select signal of each scan group is provided to the plurality of scan electrodes Row(X1)~Row(X1+3), and so on. Thereby, according to the present invention, when each scan signal is located in the select cycle and has the select signal, its adjacent scan signals are located in the non-select cycle and have the non-select signals. Accordingly, the imbalanced wire coupling effect between the select signals on adjacent scan signals can be eliminated.

In addition, in each frame, the plurality of scan signals are provided to the plurality of scan electrodes, respectively; a plurality of frames are grouped as a cycle. The waveforms of the select signal received by the Nth scan electrode in a cycle for different frames are different. Besides, in each frame, each of the scan electrodes Row(X1)~Row(X4+3) has only one select signal. In FIG. 3, a frame is shown. In the next frame, the scan signals on the plurality of scan electrodes Row(X2)~Row(X2+3) originally will replace the scan signals on the plurality of scan electrodes Row(X1)~Row(X1+3) originally; the scan signals on the plurality of scan electrodes Row(X3)~Row(X3+3) originally will replace the scan signals on the plurality of scan electrodes Row(X2)~Row(X2+3) originally, and so forth. And the scan signals on the plurality of scan electrodes Row(X1)~Row(X1+3) originally will replace the scan signals on the plurality of scan electrodes Row(X4)~Row(X4+3) originally. Thereby, after a plurality of frames, the scan signals on the plurality of electrodes Row(X4)~Row(X4+3) originally will forward replace the scan signals on the plurality of electrodes Row(X1)~Row(X1+3) originally. Then the plurality of frames form a cycle. Thus, the waveforms of the select signal received by the Nth scan electrode in a cycle for different frames will be different.

Take FIG. 3 for example. After a cycle, the waveforms of the select signal on the scan electrode Row(X1+1) received in different frames are different. In different frames, the pulses 70 on the non-select signals can be complementary and canceling out for eliminating the imbalanced wire coupling effect among scan electrodes and improving the displaying efficiency of the LCD device. Moreover, according to the present embodiment, the eliminated imbalanced wire coupling effect is produced on the non-select signals among the plurality of scan electrodes, which is different from the one shown in FIG. 2, where the eliminated imbalanced wire coupling effect is produced on the select signals among the plurality of scan electrodes. Accordingly, by combining the above two embodiments, the imbalanced wire coupling effect among scan electrode can be eliminated completely and thus improving the displaying efficiency of the LCD device.

In addition, according to the present invention, the waveforms of m types of scan signals in each scan group are distributed to different scan groups at the same time. Take FIG. 3 for example. Each scan group has 4 scan signals. There are 4 types of waveforms for the select signals of the scan signals, including the select signals b1, b2, b3, b4. At time $T_1$, the plurality of select signals a1, a2, a3, a4 are distributed to the scan electrodes Row[X1], Row[X2], Row[X3], Row[X4] of different scan groups. Likewise, at time $T_2$, the plurality of select signals a1, a2, a3, a4 are distributed to the scan electrodes Row[X1+1], Row[X2+1], Row[X3+1], Row[X4+1] of different scan groups.

Furthermore, the present invention is not limited to arranging the plurality of scan electrodes Row[X1]~Row[X1+3], Row[X2]~Row[X2+3], Row[X3]~Row[X3+3], Row[X4]~Row[X4+3] of the plurality of scan groups sequentially. The order of the plurality of scan groups can be arranged arbitrarily. Alternatively, at least a scan electrode is inserted among the plurality of scan groups. The present invention is not limited to outputting the plurality of select signals on the plurality of scan electrodes in each scan group continuously. According to the present invention, it is also possible that the plurality of scan electrodes of each scan group output the select signals, respectively, after a time interval. Take the plurality of scan electrodes Row[X1]~Row[X1+3] for example. At time $T_1$, the scan electrode Row[X1] outputs the select signal a1; at time $T_2$, the scan electrode Row[X1+1] outputs the select signal b1, and so on, where the time $T_1$ and the time $T_2$ can be spaced by a time interval.

FIG. 4 shows waveforms of the driving method for LCD device according to another embodiment of the present invention. As shown in the figure, according to the present embodiment, the principle described above that at the same time, only one of two adjacent scan electrodes has the select signal is used. In addition, in each frame, the plurality of scan signals are provided to the plurality of scan electrodes, respectively; a plurality of frames are grouped to a cycle; and the waveforms of the select signal received by the Nth scan electrode in a cycle for different frames are different. The technical features described above are described in detail in the embodiment of FIG. 3. The details will be described again.

The difference between the present embodiment and the one in FIG. 3 is that the driving method according to the present embodiment is a distributed driving method. In each frame, each scan electrode has a plurality of select signals and each select signal corresponds to a select cycle. For example, divide the select signal a1 on the scan electrode Row[X1] in FIG. 3 into four regions for forming the select signals a11, a12, a13, a14 shown in FIG. 4. Besides, At times T1. T5, T9, T13, the select signals a11, a12, a13, a14 are output to the display panel 10 for driving the display panel 10. The times T1, T5, T9, T13 are just the select cycles of the select signals a11, a12, a13, a14 on the scan electrode Row[X1], respectively. This distributed driving method is well known by a person having ordinary skill in the art. Hence, its details will not be described further.

Figure 5:
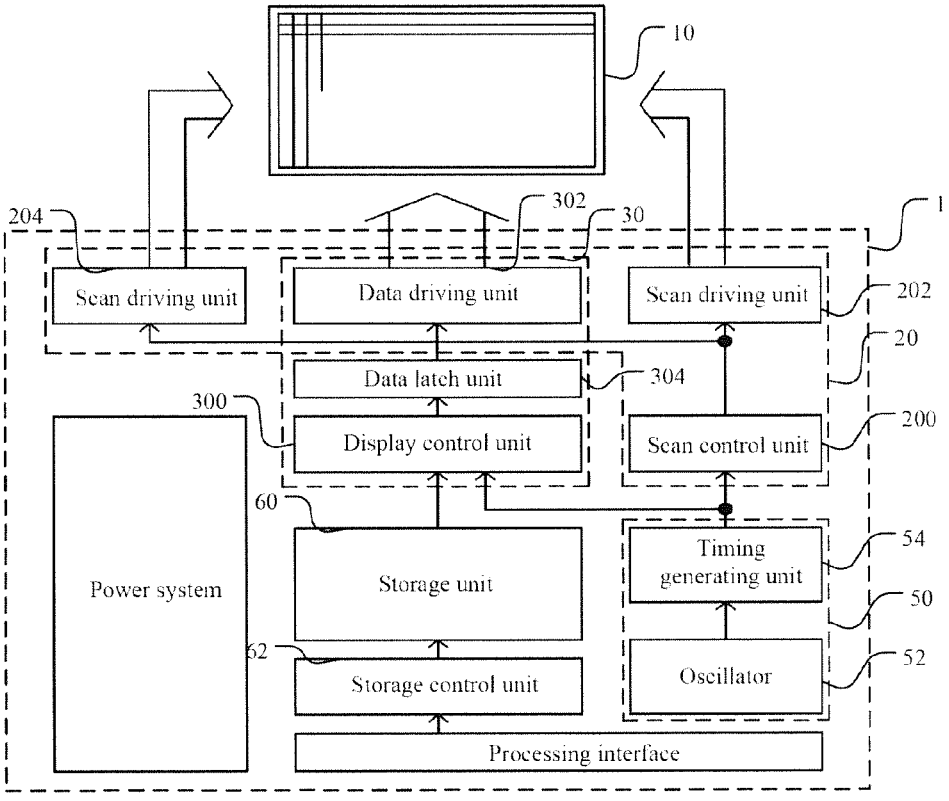
FIG. 5 shows a circuit diagram of the driving circuit of LCD device according to an embodiment of the present invention.

FIG. 5 shows a circuit diagram of the driving circuit of LCD device according to an embodiment of the present invention. As shown in the figure, the driving circuit 1 of LCD device according to the present invention comprises a scan driving circuit 20 and a data driving circuit 30. The scan driving circuit 20 is coupled to the plurality of scan electrodes of the display panel 10 and provide the plurality of scan signals to the plurality of scan electrodes of the plurality of scan groups, respectively. Each scan signal includes a select signal and a non-select signal. The select signal is located in a select cycle, while the non-select signal is located in a non-select cycle. When the Nth scan electrode is located in the select cycle, the (N−1)th or the (N+1)th scan electrode of the plurality of scan electrodes is located in the non-select cycle. The data driving circuit 30 is coupled to the plurality of data electrodes of the display panel 10, and provides a data signal to each of the data electrodes according to a plurality of display data for driving the LCD device to display an image by using the plurality of scan signals and the plurality of data signals.

Moreover, the scan driving circuit 200 according to the present invention includes a scan control unit 200 and at least a scan driving unit 202. The scan control unit 200 is used for producing the plurality of scan signals. The scan driving unit 202 is coupled to the scan control unit 202, and transmits the plurality of scan signals to the plurality of scan electrodes of the display panel, respectively, for driving the LCD device. According to the present embodiment, the scan driving circuit 10 includes two scan control units 202, 204 located on both sides of the display panel 10, respectively, for transmitting the plurality of scan signals to the plurality of scan electrodes of the display panel 10, respectively.

The data driving circuit 30 according to the present invention includes a display control unit 300 and a data driving unit 302. The display control unit 300 produces the plurality of data signals according to the display data and the plurality of scan signals. The data driving unit 302 is coupled to the display control unit 300 and transmits the plurality of data signals produced by the display control unit 300 to the plurality of data electrodes of the display panel 10 for driving the LCD device.

In addition, the data driving circuit 30 according to the present invention further includes a data latch unit 304 coupled between the display control unit 300 and the data driving unit 302. The data latch unit 304 is used for displaying and transmitting the plurality of data signals output by the control unit 300 to the data driving unit 302 for driving the LCD device.

The driving circuit 1 according to the present invention further comprises a timing control circuit 50 for producing and transmitting a timing control signal to the scan driving circuit 20 and the data driving circuit 30 for producing the plurality of scan signals and the plurality of data signals. In other word, the timing control signal produced by the timing control circuit 50 can be used as a baseband signal CLK. The scan driving circuit 20 and the data driving circuit 30 can produce the plurality of scan signals and the plurality of data signals according to the timing control signal. Besides, the description above is only an embodiment of the present invention. The timing control circuit 50 according to the present invention can also transmit the timing control signal to the scan driving circuit for producing the plurality of scan signals. Then the scan driving circuit 20 transmits the plurality of scan signals to the data driving circuit 30. The data driving circuit 30 can thereby produce the plurality of data signals according the display data and the plurality of scan signals.

Moreover, the timing control circuit 50 according to the present invention includes an oscillator 52 and a timing generating unit 54. The oscillator 52 is used for producing an oscillating signal. The timing generating unit 54 is coupled to the oscillator 52 and generates the timing control signal according to the oscillating signal.

In addition, the driving circuit 1 according to the present invention further comprises a storage unit 60 and a storage control unit 62. The storage unit 60 is used for storing the display data. The storage control unit 62 is coupled to the storage unit 60 and stores the plurality of display data to the storage unit 60.

FIG. 6 shows a circuit diagram of the layout between the driving units and the display panel of the LCD device according to the present invention. As shown in the figure, the layout relation between the driving units 102, 104 and the plurality of scan electrodes of the display panel 10 is that the plurality of scan signals of each scan group transmit to the plurality of scan electrodes of the display panel 10. Namely, firstly the driving unit 204 according to the present embodiment transmits the scan signals of the first scan group (GROUP0) to the 23rd scan group (GROUP22) sequentially to the left-side scan electrodes of the display panel 10. Next, the driving unit 202 transmits the scan signals of the 24th scan group (GROUP23) to the 46th scan group (GROUP45) sequentially to the right-side scan electrodes of the display panel 10. Thereby, the scan driving units 202, 204 according to the present embodiment have to control the timing of the select signals on the plurality of scan signals in each scan group for controlling that when the Nth scan electrode of the plurality of scan electrodes is in a select cycle, the (N−1)th or the (N+1)th scan electrode is in a non-select cycle, where the (N−1)th, the Nth, and the (N+1)th scan electrodes of the plurality of scan electrodes are adjacent scan electrodes of the scan panel 10. Thereby, the imbalanced wire coupling effect among scan electrodes can be eliminated and the displaying efficiency of the LCD device can be enhanced.

Figure 7:
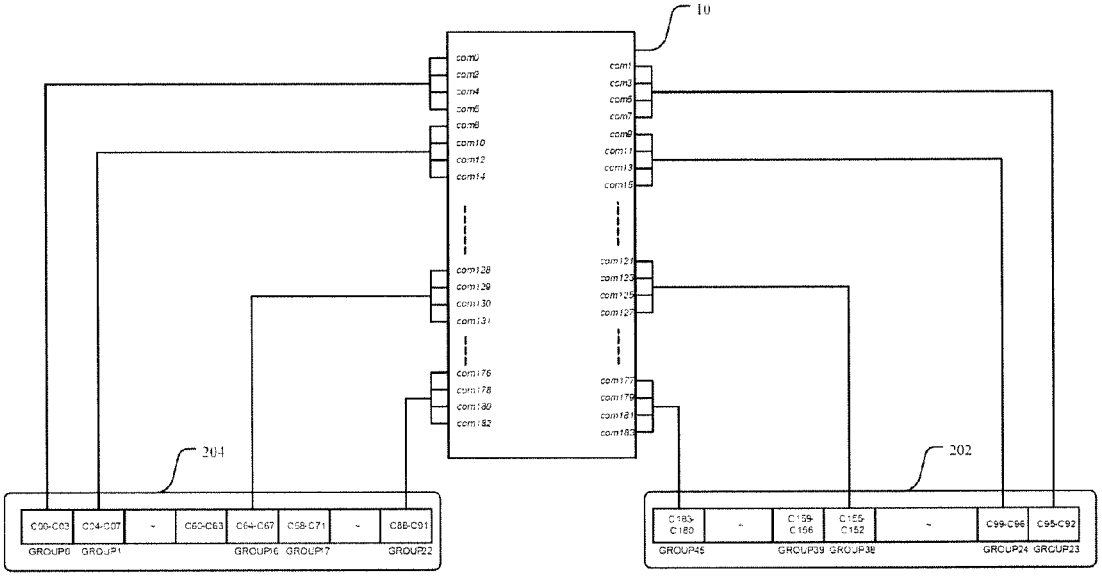
FIG. 7 shows another circuit diagram of the layout between the driving units and the display panel of the LCD device according to the present invention.

FIG. 7 shows another circuit diagram of the layout between the driving units and the display panel of the LCD device according to the present invention. As shown in the figure, the difference between the present embodiment and the one in FIG. 6 is that the plurality of scan electrodes according to the present embodiment are arranged in an interlaced order on both sides of the display panel 10. That is to say, according to the present invention, the order of the scan signals received by the plurality of scan electrodes of the display panel 10 is changed to the order that the odd scan electrodes are located on the right side of the display panel 10 (com1~com183) while the even ones are located on the left side of the display panel 10 (com0~com182). Thereby, by altering the layout structure according to the present embodiment, the adjacent scan electrodes can be located in the non-select cycles when the Nth scan electrode of the plurality of scan electrodes of the display panel 10 is located in the select cycle.

Figure 8A:
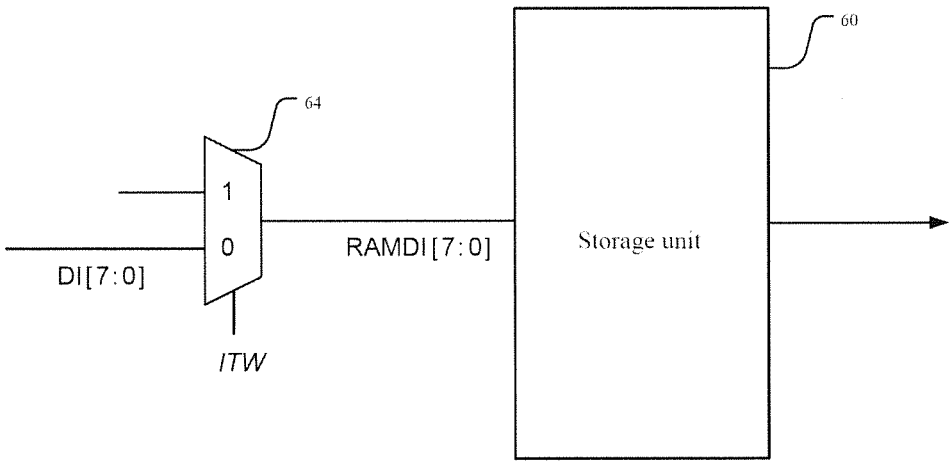
FIG. 8A shows a schematic diagram of accessing the storage unit of the LCD device according to the present invention.

FIG. 8A shows a schematic diagram of accessing the storage unit of the LCD device according to the present invention. As shown in the figure, the input of the storage unit 60 according to the present embodiment is coupled to a storage selecting unit 64 and the storage selecting unit 64 is controlled by a select signal ITW. The select signal ITW is produced by the storage control unit 62, so that the plurality of display data can be stored to the storage unit 60 according to a storage index table. The storage index table according to the present invention changes the storage location of the plurality of display data in the storage unit 60. By accompanying the layout structure between the driving units and the display panel 10 shown in FIG. 6, when the Nth scan electrode of the plurality of scan electrodes is in the select cycle, the (N−1)th or the (N+1)th scan electrode is in the non-select cycle. Namely, the staggered adjacent scan electrodes will not receive the select signal of the scan signal at the same time; the adjacent scan electrodes will not be located in the select cycle simultaneously. Thereby, the imbalanced wire coupling effect among scan electrodes can be eliminated and the displaying efficiency of the LCD device can be enhanced.

FIG. 8B shows an index table of accessing the storage unit of the LCD device according to the present invention. As shown in the figure, the storage unit 60 has eight storage locations RAMDI[0]~RAMDI[7] originally corresponding to the stored display data DI[0]~DI[7]. Instead, the storage selecting unit 64 according to the present embodiment stores the display data DI[0], DI[2], DI[4], DI[6], DI[1], DI[3], DI[5], DI[7] to the storage locations RAMDI[0]~RAMDI[7] of the storage unit 60, respectively, according to the select signal ITW for matching the layout structure in which the scan electrodes are arranged in an interlaced order on both sides of the display panel 10. Thereby, the imbalanced wire coupling effect among scan electrodes can be eliminated and the displaying efficiency of the LCD device can be enhanced. Besides, because the present embodiment adopts the storage index table and the layout structure of arranging the plurality of scan electrodes on both sides of the display panel in an interlaced order, no significant change on the structure of the driving circuit of the LCD device is required, and thus achieving the purpose of saving cost.

Figure 9A:
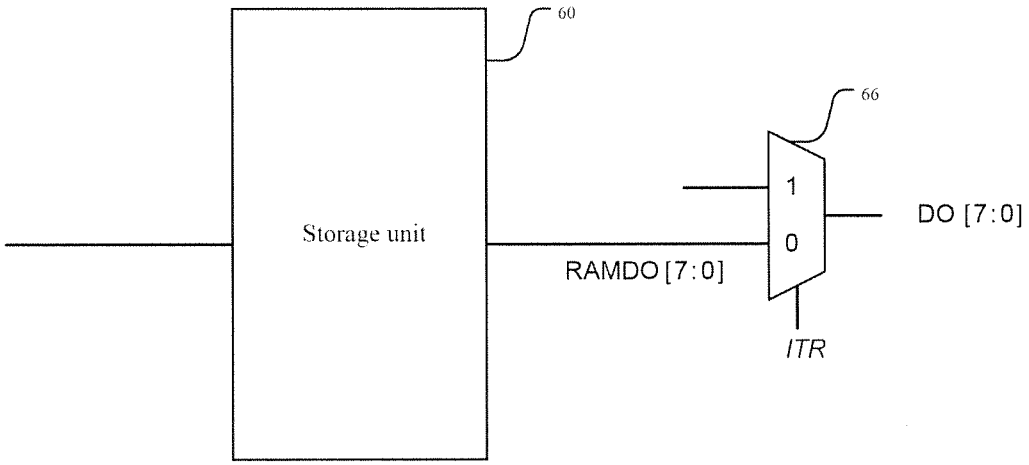
FIG. 9A shows another schematic diagram of accessing the storage unit of the LCD device according to the present invention.

FIG. 9A shows another schematic diagram of accessing the storage unit of the LCD device according to the present invention. As shown in the figure, the output of the storage unit 60 according to the present embodiment is coupled to a read selecting unit 66 and the read selecting unit 66 is controlled by a select signal ITR. The select signal ITR is produced by the storage control unit 62, so that the plurality of display data can be read from the storage unit 60 according to a read index table. The read index table according to the present invention changes the reading location of the plurality of display data in the storage unit 60. By accompanying the layout structure between the driving units and the display panel 10 shown in FIG. 6, when the Nth scan electrode of the plurality of scan electrodes is in the select cycle, the (N−1)th or the (N+1)th scan electrode is in the non-select cycle. Namely, the staggered adjacent scan electrodes will not receive the select signal of the scan signal at the same time; the adjacent scan electrodes will not be located in the select cycle simultaneously. Thereby, the imbalanced wire coupling effect among scan electrodes can be eliminated and the displaying efficiency of the LCD device can be enhanced.

FIG. 9B shows another index table of accessing the storage unit of the LCD device according to the present invention. As shown in the figure, the storage unit 60 has eight storage locations RAMDO[0]~RAMDO[7] originally corresponding to the stored display data DO[0]~DO[7]. Instead, the read selecting unit 66 according to the present embodiment changes the reading method. In other words, the reading sequence of the plurality of storage locations is changed from RAMDO[0]~RAMDO[7] to RAMDO[0], RAMDO[4], RAMDO[1], RAMDO[5], RAMDO[2], RAMDO[6], RAMDO[3], RAMDO[7], respectively, according to the select signal ITR for matching the layout structure in which the scan electrodes are arranged in an interlaced order on both sides of the display panel 10. Thereby, the imbalanced wire coupling effect among scan electrodes can be eliminated and the displaying efficiency of the LCD device can be enhanced. Besides, because the present embodiment adopts the read index table and the layout structure of arranging the plurality of scan electrodes on both sides of the display panel in an interlaced order, no significant change on the structure of the driving circuit of the LCD device is required, and thus achieving the purpose of saving cost.

To sum up, the present invention relates to a driving method for LCD device and the driving circuit thereof. The LCD device comprises a plurality of scan groups and a plurality of data electrodes; each scan group comprises a plurality of scan electrodes. The driving method comprises the following steps. First the scan driving circuit provides a plurality of scan signals to the plurality of scan electrodes of the plurality of scan groups, respectively. Each scan signal includes at least a select signal, at least a non-select signal, at least a select cycle, and at least a non-select cycle. The select signal is located in the select cycle, while the non-select signal, the non-select cycle. When an Nth scan electrode is located in the select cycle, an (N−1)th or (N+1)th scan electrode of the plurality of scan electrodes is located in the non-select cycle. Then, the data driving circuit provides a data signal to each of the data electrodes according to a plurality of display data for driving the LCD device to display an image by using the plurality of scan signals and the plurality of data signals. Thereby, the imbalance wire coupling effect among scan electrodes can be eliminated and thus improving the display efficiency of the LCD device.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving method for a liquid crystal display device, said liquid crystal display device comprising a plurality of scan groups and a plurality of data electrodes and each said scan group comprising a plurality of scan electrodes, and comprising steps of:

providing a plurality of scan signals to said plurality of scan electrodes of said plurality of scan groups, respectively, each scan signal comprising at least a select signal, at least a non-select signal, at least a select cycle, and at least a non-select cycle, said select signal located in said select cycle, said non-select signal located in said non-select cycle, and an (N−1)th scan electrode and an (N+1)th scan electrode of said plurality of scan electrodes located in said select cycle when an Nth scan electrode of said plurality of scan electrodes is located in said non-select cycle; and providing a plurality of data signals to each of said data electrodes according to a plurality of display data for driving said liquid crystal display device to display an image by using said plurality of scan signals and said plurality of data signals;

where said (N−1)th scan electrode, said Nth scan electrode, and said (N+1)th scan electrode are adjacent scan electrodes on a display panel;

wherein each selected electrode within each said scan group receives its respective said select signal at a different time within the select cycle.

2. The driving method of claim 1, wherein in each frame, provide said plurality of scan signals to said plurality of scan electrodes, respectively; group a plurality of frames to a cycle; and waveforms of said select signal received by the Nth scan electrode in different frames in said cycle are different.

3. The driving method of claim 2, wherein said select signal has m types of waveforms and m≥2.

4. The driving method of claim 1, wherein in each frame, each of said scan electrodes has only one select signal.

5. The driving method of claim 1, wherein in each frame, each of said scan electrodes has a plurality of select signals.

6. A driving circuit of a liquid crystal display device, said liquid crystal display device comprising a display panel, a plurality of scan groups, and a plurality of data electrodes, each said scan group comprising a plurality of scan electrodes, and said driving circuit comprising:

a scan driving circuit, coupled to said plurality of scan electrodes of said display panel, providing a plurality of scan signals to said plurality of scan electrodes of said plurality of scan groups, respectively, each scan signal comprising at least a select signal, at least a non-select signal, at least a select cycle, and at least a non-select cycle, said select signal located in said select cycle, said non-select signal located in said non-select cycle, and an (N−1)th scan electrode and an (N+1)th scan electrode of said plurality of scan electrodes located in said select cycle when an Nth scan electrode of said plurality of scan electrodes is located in said non-select cycle; and a data driving circuit, coupled to said plurality of data electrodes of said display panel, and providing a plurality of data signals to each of said data electrodes according to a plurality of display data for driving said liquid crystal display device to display an image by using said plurality of scan signals and said plurality of data signals;

where said (N−1)th scan electrode, said Nth scan electrode, and said (N+1)th scan electrode are adjacent scan electrodes on said display panel;

wherein each selected electrode within each said scan group receives its respective said select signal at a different time within the select cycle.

7. The driving circuit of claim 6, wherein in each frame, said driving circuit provides said plurality of scan signals to said plurality of scan electrodes, respectively; group a plurality of frames to a cycle; and waveforms of said select signal received by the Nth scan electrode in different frames in said cycle are different.

8. The driving circuit of claim 7, wherein said select signal has m types of waveforms and m≥2.

9. The driving circuit of claim 6, wherein in each frame, each of said scan electrodes of the liquid crystal display device has only one select signal.

10. The driving circuit of claim 6, wherein in each frame, each of said scan electrodes of the liquid crystal display device has a plurality of select signals.

11. The driving circuit of claim 6, wherein said plurality of scan electrodes are arranged in an interlaced order on both sides of said display panel.

12. The driving circuit of claim 6, wherein said scan driving circuit comprises: a scan control unit, used for producing said plurality of scan signals; and at least a scan driving unit, coupled to said scan control unit, and transmitting said plurality of scan signals to said plurality of scan electrodes, respectively, for driving said liquid crystal display device.

13. The driving circuit of claim 6, wherein said data driving circuit comprises:

a display control unit, producing said plurality of data signals according to said plurality of display data and said plurality of scan signals; and a data driving unit, coupled to said display control unit, and transmitting said plurality of data signals to said plurality of data electrodes for driving said liquid crystal display device.

14. The driving circuit of claim 6, and further comprising a timing control unit, used for producing and transmitting a timing control signal to said scan driving circuit and said data driving circuit for producing said plurality of scan signals and said plurality of data signals.

15. The driving circuit of claim 6, and further comprising:

a storage unit, used for storing said plurality of display data; and a storage control unit, coupled to said storage unit, and storing or reading said plurality of display data of said storage unit according an index table.

* * * * *